US006260680B1

(12) United States Patent
Lin

(10) Patent No.: US 6,260,680 B1
(45) Date of Patent: Jul. 17, 2001

(54) STRUCTURAL FRAME OF LUGGAGE

(75) Inventor: Jer Hong Lin, Taipei (TW)

(73) Assignee: Chaw Khong Technology Co., Ltd., Taipei (TW)

( * ) Notice: Subject to any disclaimer, the term of this patent is extended or adjusted under 35 U.S.C. 154(b) by 0 days.

(21) Appl. No.: 09/543,562

(22) Filed: Apr. 5, 2000

(30) Foreign Application Priority Data

Sep. 23, 1999 (TW) ..... 88216267

(51) Int. Cl.[7] ..... A45C 5/14; A45C 13/04; A45C 13/10; A45C 13/36

(52) U.S. Cl. ..... 190/119; 190/18 A; 190/24; 190/115; 190/123; 190/127

(58) Field of Search ..... 190/107, 122, 190/119, 127, 123, 201

(56) References Cited

U.S. PATENT DOCUMENTS

| | | | | |
|---|---|---|---|---|
| 3,447,649 | * | 6/1969 | Kish, Jr. | 190/127 X |
| 3,958,676 | * | 5/1976 | March | 190/127 X |
| 4,629,040 | * | 12/1986 | Hones | 190/122 X |
| 5,086,888 | * | 2/1992 | Chu | 190/127 X |
| 5,103,945 | * | 4/1992 | Kaneko | 190/127 X |
| 5,252,161 | * | 10/1993 | Chang et al. | 190/127 X |
| 5,782,325 | * | 7/1998 | O'Shea et al. | 190/127 X |
| 6,109,404 | * | 8/2000 | Bishop | 190/127 X |
| 6,119,835 | * | 9/2000 | Lin | 190/127 |

FOREIGN PATENT DOCUMENTS

| | | | | |
|---|---|---|---|---|
| 619686 | * | 3/1949 | (GB) | 190/127 |
| 2024612 | * | 1/1980 | (GB) | 190/127 |

* cited by examiner

*Primary Examiner*—Sue A. Weaver
(74) *Attorney, Agent, or Firm*—Dougherty & Troxell

(57) ABSTRACT

A luggage frame assembly comprises a fabric frame and a plastic frame wherein plastic frame is a closed member except the open front side, mating fasteners are equally spaced apart around the inner surface of the peripheral edge of the open front side of plastic frame, a steel cable frame is formed around the peripheral edge of the open front side of fabric frame, a zipper is fastened around the peripheral edge of the open front side of fabric frame to secure to the steal cable frame, and opposite mating fasteners are equally spaced apart around the inner surface of the joining of the zipper and the steel cable frame. Mating fasteners cling to opposite mating fasteners to secure fabric frame and plastic frame at the peripheral edges of the front side of the luggage in assembly.

12 Claims, 8 Drawing Sheets

STRUCTURAL FRAME OF LUGGAGE

BACKGROUND OF THE INVENTION

1. Field of the Invention

The present invention relates to luggage and more particularly to a structural frame of luggage.

2. Description of Related Art

A conventional structural frame of luggage comprises a generally parallelpiped frame with board or plastic plate mounted on top and bottom respectively such that a bezel and attached retractable handle may be mounted on top, while bottom plate and kick plate may be mounted on bottom. Wheels are provided at two opposing edges of bottom of frame. In assembly, first wrap a fabric on the frame. Then mount bottom plate and kick plate on the frame. Finally, mount bezel and wheels to complete a luggage. However, such luggage does not have a sufficient strength such that wrinkle may appear on the fabric frame. This is unsightly. An improved wheeled luggage is disdosed by luggage manufacturer as shown in FIGS. 1A and 1B comprising a plastic frame F, a fabric frame E wrapped around plastic frame F, wheels W, handle H and a cover C wherein fabric frame E and plastic frame F are secured together by bezel B and supports B1 and B2, and fabric frame E and cover C are fastened by zippers Z1 and Z2. It is known that a gap G exists between fabric frame E and plastic frame F at one side because fabric frame E and plastic frame F are secured at the top and bottom of luggage only (FIG. 1B). Such gap G is still unsightly. It is also known that two sides of fabric frame E and plastic frame F are not engaged well as compared to that achieved by steel cable S on rear periphery at the rear plate of luggage.

Thus improvement still exists.

SUMMARY OF THE INVENTION

It is an object of the present invention to provide a structural frame of luggage for eliminating all drawbacks associated with conventional luggage.

It is another object of the present invention to provide a novel structural frame of luggage wherein the frame is a closed member except the open front side. Frame has a peripheral groove around the rear side for enhancing the strength of frame. A steel cable frame is formed around peripheral edge of the open front side of fabric frame. Fastener means are equally spaced apart around peripheral edge of the open front side of fabric frame and plastic frame for securing plastic frame and fabric frame together. This achieves a very flat surface on each of top, bottom, two sides, and a rear side of luggage. This luggage is also an aethetically pleasing device. With this structural frame, assembly and detachment both are easy.

To achieve the above and other objects, the present invention provides a luggage comprising a fabric frame, a plastic frame, a cover, a retractable handle, a bezel, a support for fastening the retractable handle, and wheels wherein the plastic frame is a closed member except the open front side, a plurality of mating fasteners are equally spaced apart around the inner surface of the peripheral edge adjacent the open front side of the plastic frame, a steel cable frame is formed around the peripheral edge of the open front side of the fabric frame, a zipper is fastened around the peripheral edge of the open front side of fabric frame to secure to the steel cable frame, and a plurality of opposite mating fasteners are equally spaced apart around the inner surface of the joining of the zipper and the peripheral steel cable frame. In assembly, fabric frame and plastic frame are engaged. Then the mating fasteners cling to the opposite mating fasteners to secure fabric frame and plastic frame at the peripheral edge of the front side of luggage. Finally, fasten cover on the secured fabric frame and plastic frame to form a complete luggage.

The above and other objects, features and advantages of the present invention will become apparent from the following detailed description taken with the accompanying drawings.

DETAILED DESCRIPTION OF THE PREFERRED EMBODIMENTS

Figure 1:
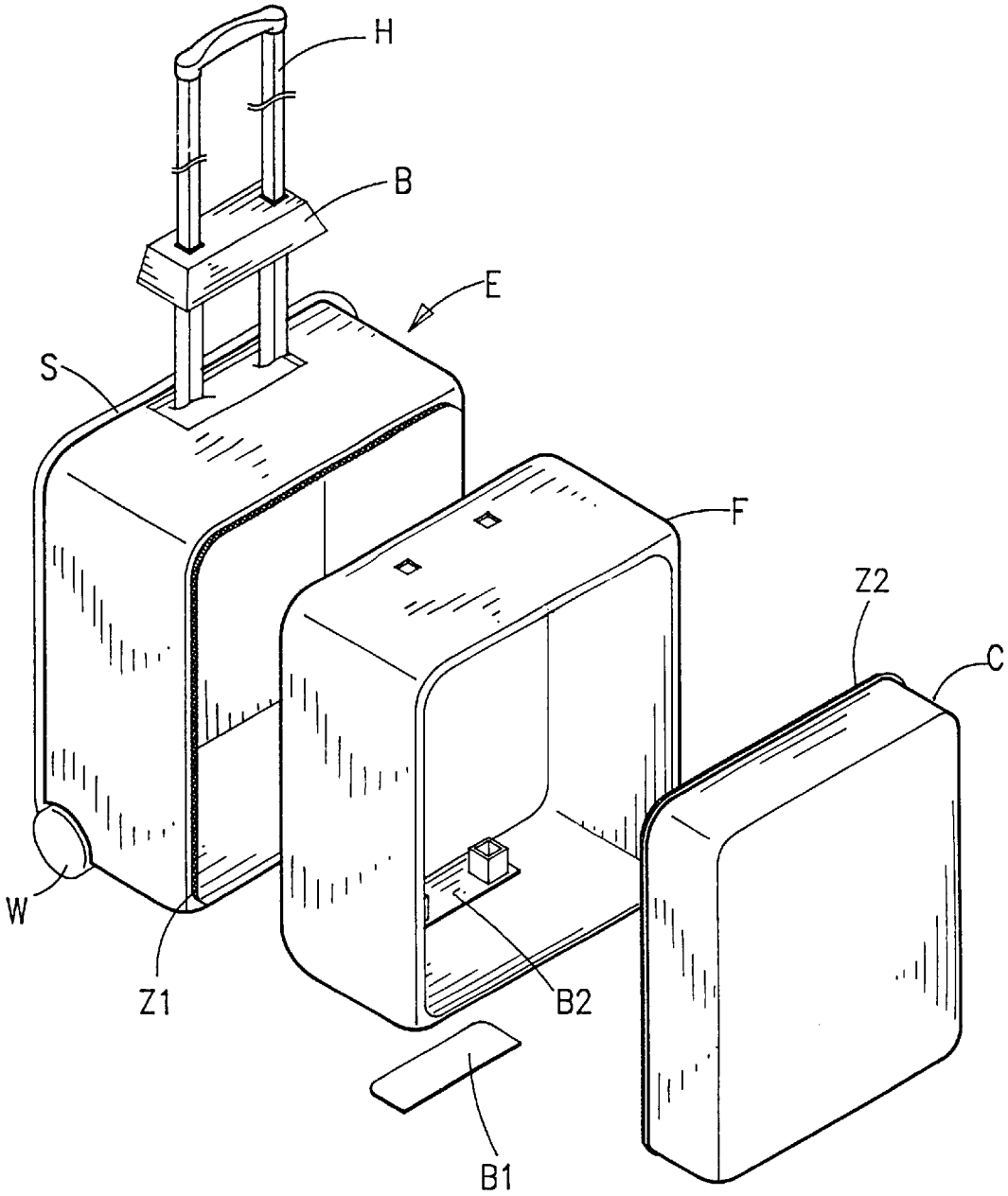
FIG. 1 A (PRIOR ART)
FIG. 1A is an exploded perspective view of a prior art luggage.
FIG. 1B is a perspective view of FIG. 1A with the cover open.
Figure 1:
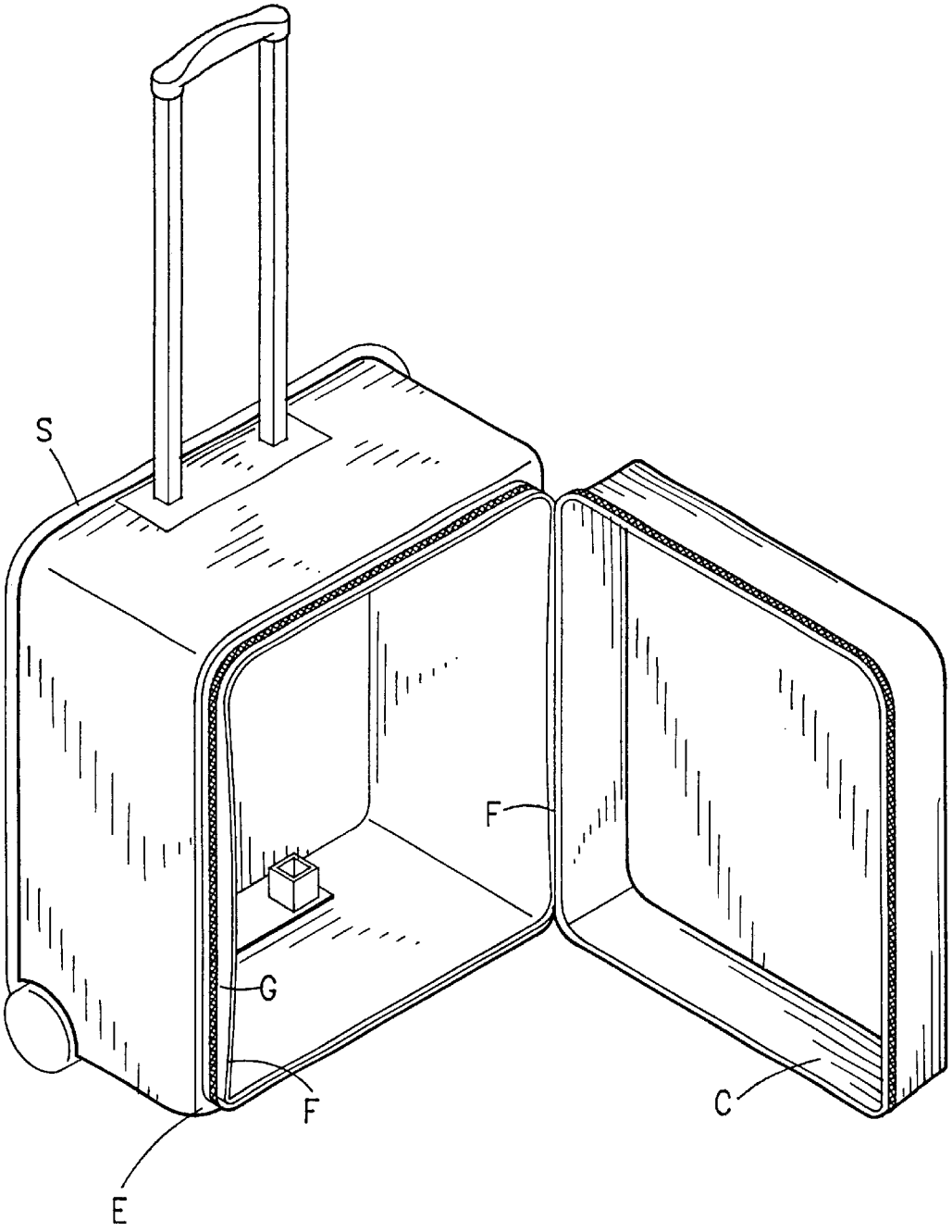
FIG. 1 B (PRIOR ART)

Referring to FIGS. 2–7, there is shown a first embodiment of a luggage constructed in accordance with the invention comprising a fabric frame 10, a plastic frame 20, a cover 30, a retractable handle assembly 40, a pair of longitudinal grooves 25 formed integrally with plastic frame 20 for receiving the tubular members of the retractable handle assembly 40, a bezel 24, and wheels 50. The description of the conventional retractable handle assembly 40, wheels 50, and bezel 24 is omitted herein for not obscuring the invention.

Figure 2:
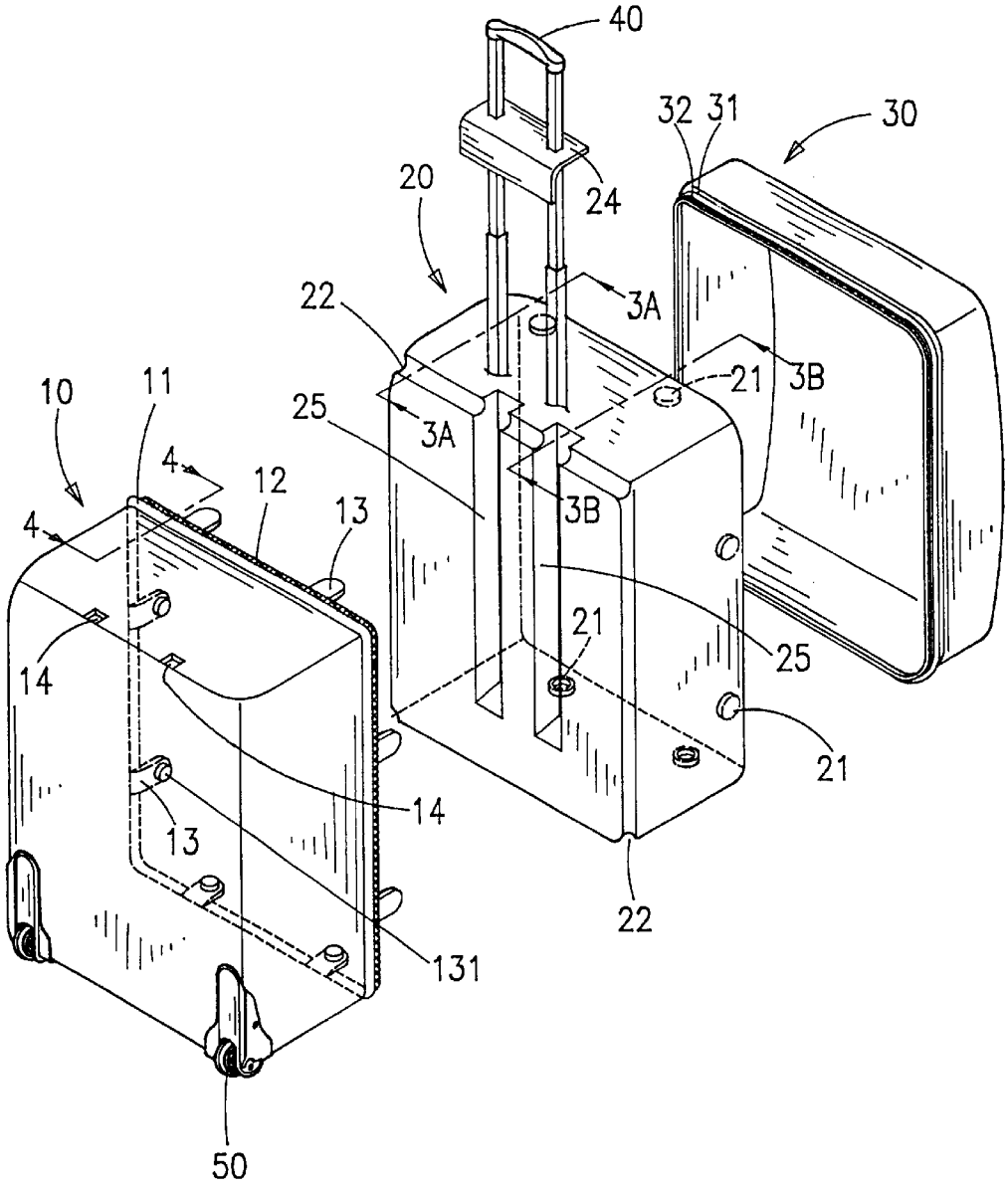
FIG. 2 is an exploded perspective view of a first embodiment of luggage of the invention.
Figure 6:
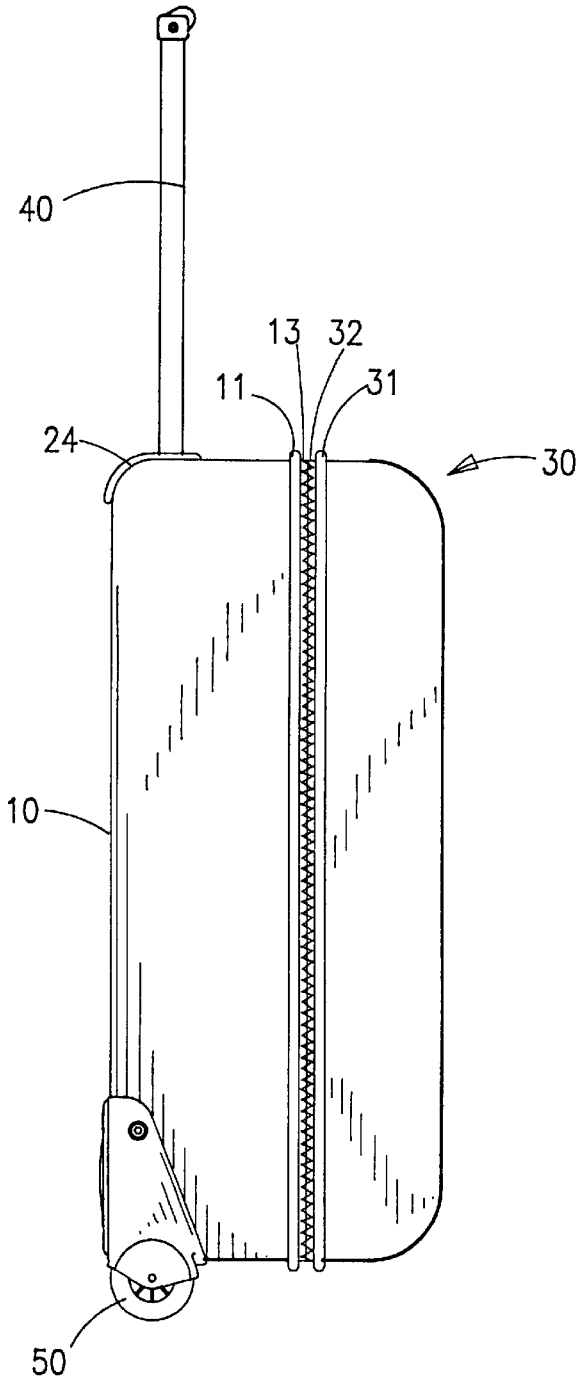
FIG. 6 is a side view of FIG. 2 with the cover closed.
Figure 3A:
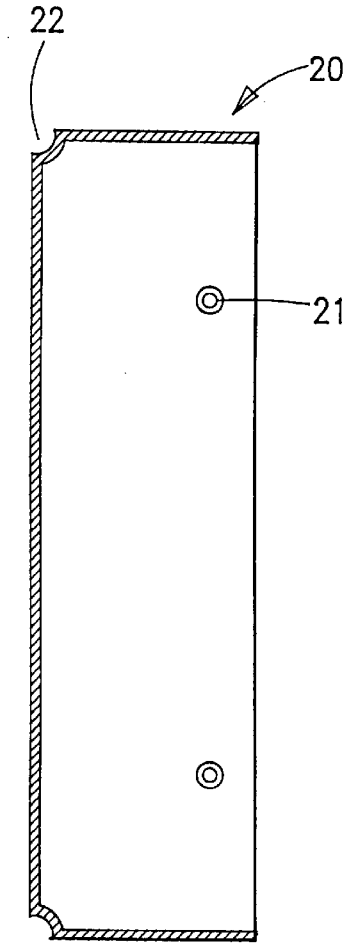
FIG. 3A is a sectional view taken along line 3A—3A of FIG. 2.
Figure 3B:
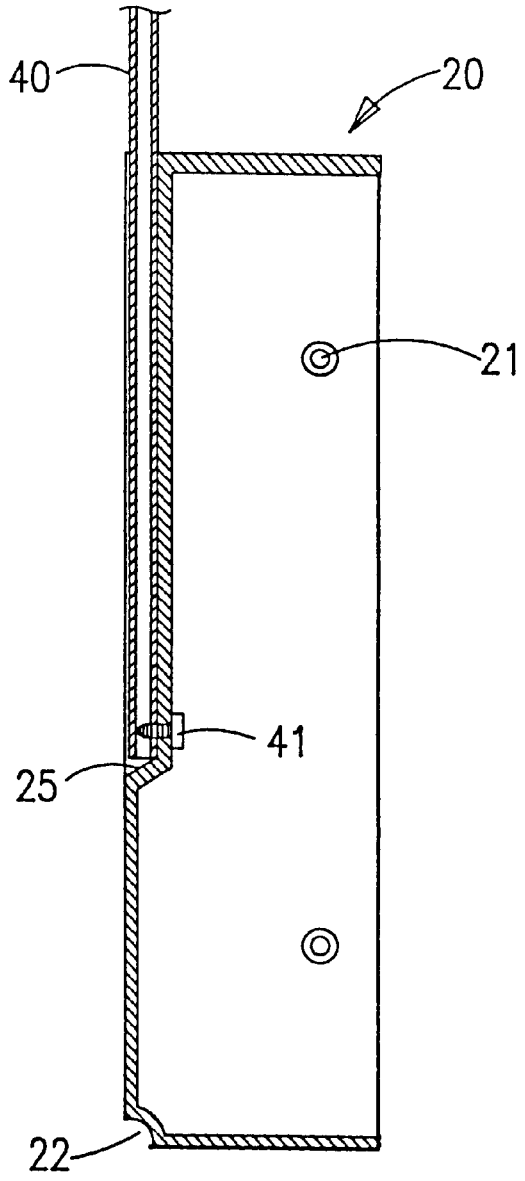
FIG. 3B is a sectional view taken along line 3B—3B of FIG. 2.

The characteristics of the invention is described as follows. The conventional plastic frame has open front and rear sides, while the plastic frame 20 of the invention is a closed member except the open front side. Further, a peripheral groove 22 is formed around the rear side of plastic frame 20 for enhancing the strength thereof (FIGS. 2 and 3A). The peripheral groove 22 is formed integrally with the thermoplastic plastic frame 20 in one molding. It is understood that if the plastic frame 20 is fashioned from durable, fracture resistant thermoplastic as well as has a sufficient thickness such peripheral groove 22 may be omitted without departing from the spirit of the invention. The longitudinal grooves 25 are also formed integrally with plastic frame 20 on the rear for enhancing the strength of plastic frame 20, receiving the tubular members of the retractable handle assembly 40, and facilitating the mounting of the bezel 24 (FIGS. 2 and 3B). Further, a plurality of female fasteners 21 are equally spaced apart around the inner surface of the peripheral edge adjacent the open front side of plastic frame 20.

Similarly, fabric frame 10 is also a closed member except the open front side. The fabric frame 10 has a size conformed to the plastic frame 20. A pair of openings 14 are provided on the top of fabric frame 10 being aligned with longitudinal grooves 25. Such that after fabric frame 10 and plastic frame 20 are secured, the tubular members of the retractable handle assembly 40 may insert through the openings 14 and the longitudinal grooves 25 to be anchored in the bottom of luggage by means of fasteners such as screws 41 (FIG. 3B).

Figure 4:
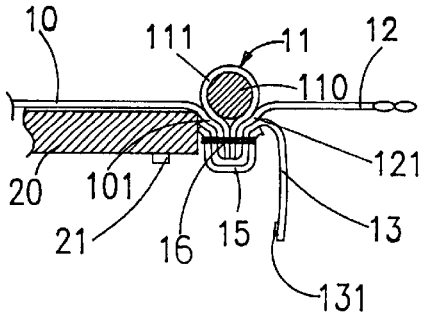
FIG. 4 is a sectional view taken along line 44 of FIG. 2.
Figure 5:
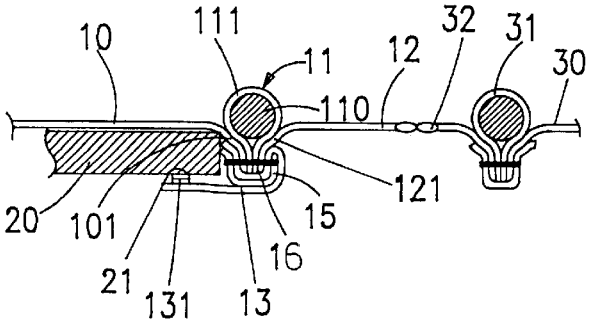
FIG. 5 is a partial sectional view showing the connection between fabric frame and plastic frame.

In one aspect of the fabric frame 10 of the invention, the peripheral steel cable frame 11 provided around the rear side of luggage implemented in the prior art is changed to form around the front side of fabric frame 10. Further, a plurality of male fasteners 13 are equally spaced apart around the inner surface of the peripheral edge 101 of the open front side of fabric frame 10 to cling to the mating female fasteners 21 to secure fabric frame 10 to plastic frame 20. In detail, as shown in FIGS. 4 and 5, peripheral edge 101 of fabric frame 10, circumferential fabric edge 111 of steel cable frame 11, one side portion 121 of zipper 12, the inner side of male fasteners 13, and fabric enlargement 15 are stitched together by thread 16 (FIG. 4). It is seen that peripheral steel cable frame 11 is secured between fabric frame 10 and zipper 12. Note that the plurality of male fasteners 13 are stitched to the side portion 121 of the zipper 12. As stated above, male fasteners 13 cling to the mating female fasteners 21 to secure fabric frame 10 to plastic frame 20 (FIG. 5).

The description of cover 30 is omitted herein because it is a prior art element.

Figure 9:
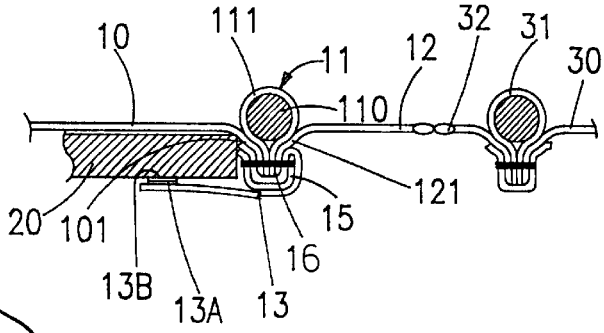
FIG. 9 is a partial sectional view showing the connection between fabric frame and plastic frame of FIG. 8.
Figure 7:
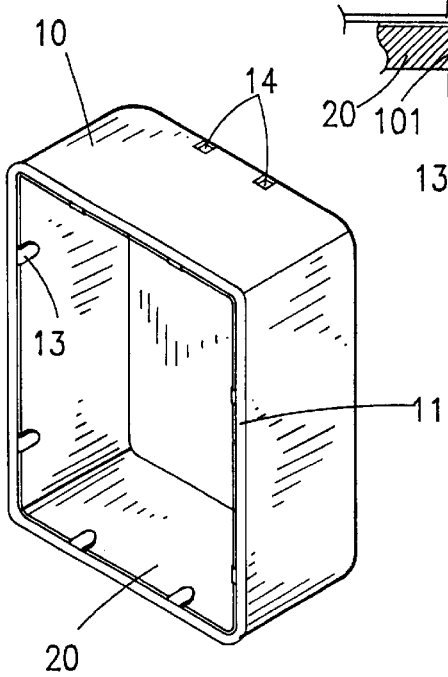
FIG. 7 is a perspective view showing assembled fabric frame and plastic frame.
Figure 8:
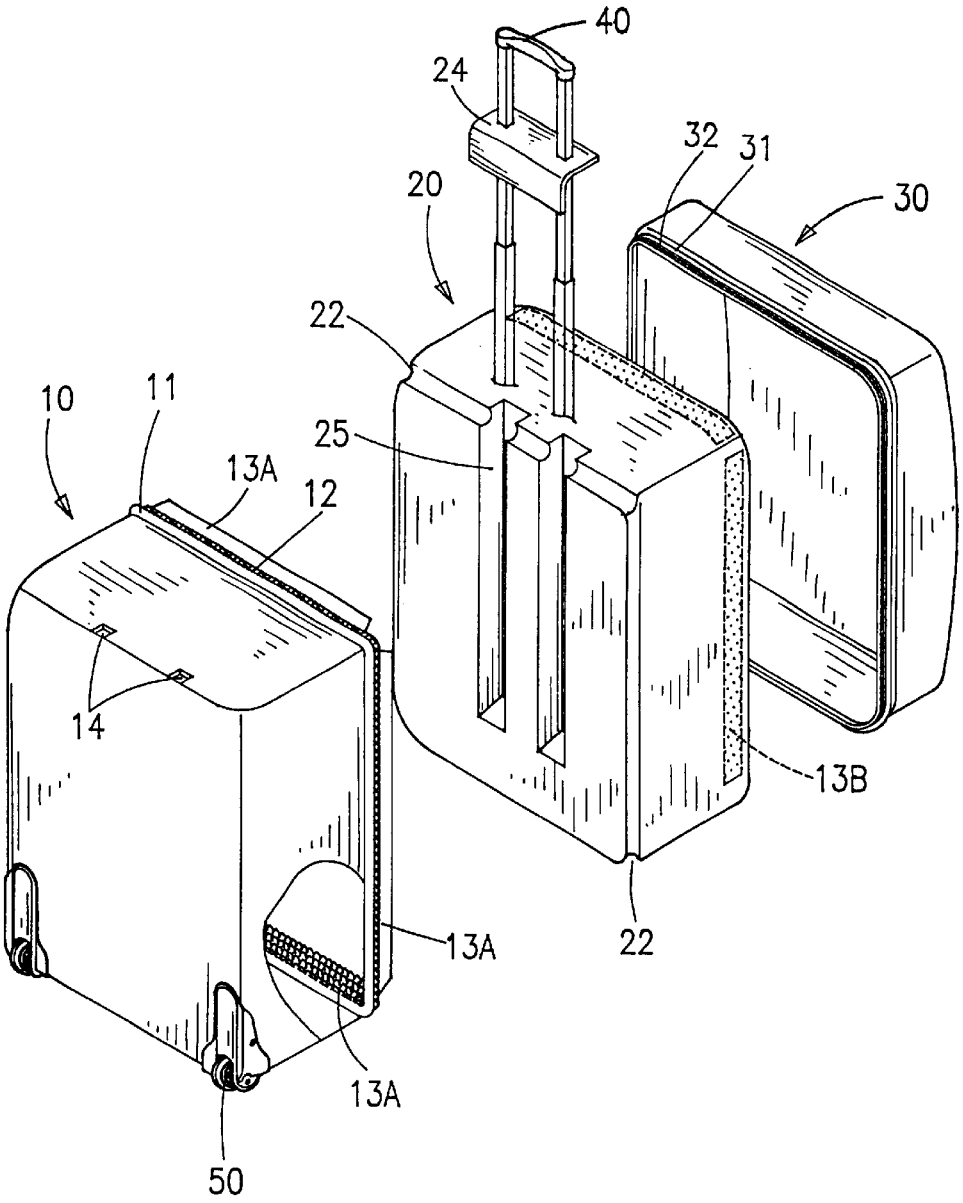
FIG. 8 is an exploded view of a second embodiment of luggage of the invention.

FIGS. 8–9 illustrate a second embodiment of luggage of the invention. This embodiment substantially has the same configuration as first embodiment except that the male fasteners 13 and female fasteners 21 of the first embodiment are replaced by a plurality of hook and loop type fasteners 13A and 13B for further securing fabric frame 10 to plastic frame 20 at the peripheral edge of the front side of luggage (FIG. 9).

Figure 10:
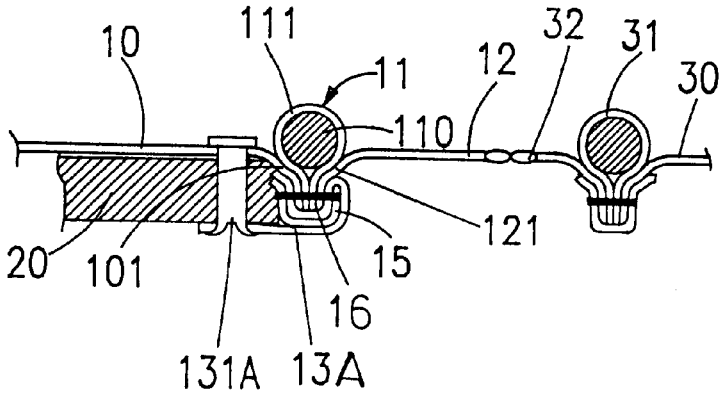
FIG. 10 is a partial sectional view of a third embodiment of luggage of the invention.

FIG. 10 illustrates a third embodiment of luggage of the invention. This embodiment substantially has the same configuration as first embodiment except that the fastening technique employed in the first embodiment are replaced by a further technique such as stitching fabric frame 10, steel cable frame 11, zipper 12, a tab attached to wrapping member 15, and wrapping member 15 together by thread 16, then, use one or more rivets 131A to fasten the fabric frame 10, plastic frame 20, and the free end of the tab attached to wrapping member 15 together.

Figure 11:
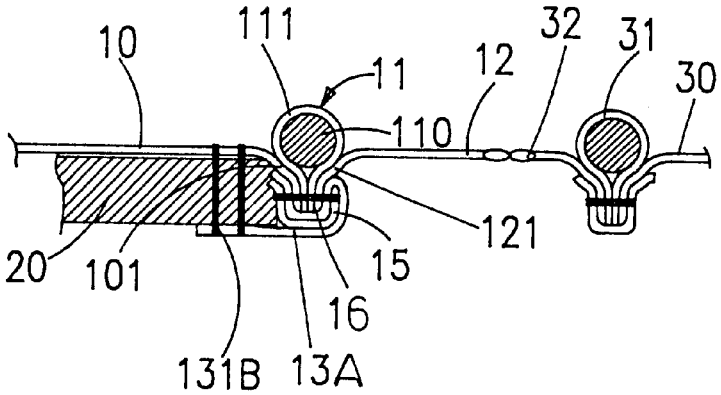
FIG. 11 is a portable sectional of a forth embodiment of luggage of the invention.

FIG. 11 is a sectional view of a fourth embodiment of luggage of the invention. This embodiment substantially has the same configuration as third embodiment except that the rivets 131A are replaced by strong thread 131B.

While the invention herein disclosed has been described by means of specific embodiments, numerous modifications and variations could be made thereto by those skilled in the art without departing from the scope of the invention set forth in the claims.

What is claimed is:

1. A luggage comprising:

a fabric frame having six sides with a front side open, a steel cable frame attached around a peripheral edge of an open front side of the fabric frame, a zipper fastened around the peripheral edge of the open front side of the fabric frame to secure to the steel cable frame, and a plurality of first mating fasteners equally spaced apart around an inner surface of a joining of the zipper and the steel cable frame;

a plastic frame having six sides with a front side open and a plurality of second, opposite mating fasteners equally spaced apart around an inner surface of a peripheral edge of an open front side of the plastic frame;

a cover;

a retractable handle;

a bezel;

a base support for fastening a bottom of the retractable handle; and wheels, wherein the mating first and second fasteners cling to each other to secure the fabric frame and the plastic frame together at peripheral edges of the front side of the fabric frame and the plastic frame.

2. The luggage of claim 1, wherein each of the first mating fasteners is a male fastener and each of the second, opposite mating fasteners is a female fastener.

3. The luggage of claim 1, wherein the first and second mating fasteners comprise hook and loop fasteners.

4. The luggage of claim 1, further comprising a peripheral groove formed around a rear side of the plastic frame for enhancing the strength thereof.

5. The luggage of claim 1, wherein the bezel is formed integrally with a top of the plastic frame.

6. A luggage comprising:

a fabric frame having six sides with a front side open, a steel cable frame attached around a peripheral edge of an open front side of the fabric frame, a zipper fastened around the peripheral edge of the open front side of the fabric frame to secure to the steel cable frame, and a first fastener formed in an inner surface of a joining of the zipper and the steel cable frame;

a plastic frame having six sides with an open front side and a second fastener formed in an inner surface of a peripheral edge of the open front side of the plastic frame;

a cover;

a retractable handle;

a bezel;

a base support for fastening a bottom of the retractable handle; and wheels, wherein the first fastener clings to the second fastener to secure the fabric frame and the plastic frame at the peripheral edges of the front side of the fabric frame and the plastic frame.

7. The luggage of claim 6, wherein the first and second fasteners comprise long tapes of hook and loop fasteners.

8. The luggage of claim 6, further comprising a peripheral groove formed around a rear side of the plastic frame for enhancing the strength thereof.

9. The luggage of claim 6, wherein the bezel is formed integrally with a top of the plastic frame.

10. A luggage comprising:

a fabric frame having six sides with an open front side, a steel cable frame attached around a peripheral edge of the open front side of the fabric frame, a zipper fastened around the peripheral edge of the open front side of the fabric frame to secure to the steel cable frame;

a plastic frame having six sides with an open front side and a fastener member provided in an inner surface of a peripheral edge of the open front side of the plastic frame;

a cover;

a retractable handle;

a bezel;

a base support for fastening a bottom of the retractable handle;

wheels, and a fixing device clings to the fastener member to secure the fabric frame and the plastic frame at the peripheral edges of the front side of the fabric frame and the plastic frame.

11. The luggage of claim 10, wherein the fixing device is a plurality of rivets and the fastener member is a tab.

12. The luggage of claim 10, wherein the fixing device comprises stitches and the fastener member is a tab.

* * * * *